US005758510A

United States Patent [19]

Cho

[11] Patent Number: 5,758,510

[45] Date of Patent: Jun. 2, 1998

[54] TIME SHARED DUAL EVAPORATOR CYCLE REFRIGERATOR

[75] Inventor: Jae Hyun Cho, Seoul, Rep. of Korea

[73] Assignee: LG Electronics, Inc., Seoul, Rep. of Korea

[21] Appl. No.: 698,698

[22] Filed: Aug. 16, 1996

[30] Foreign Application Priority Data

Aug. 17, 1995 [KR] Rep. of Korea ..... 1995-25285

[51] Int. Cl.[6] ..... F25B 41/04; F25B 5/00

[52] U.S. Cl. ..... 62/220; 62/504; 62/199

[58] Field of Search ..... 62/198, 199, 200, 62/503, 504–509, 512, 525, 218, 219, 220

[56] References Cited

U.S. PATENT DOCUMENTS

| | | | |
|---|---|---|---|
| 1,645,314 | 10/1927 | Williams | 62/219 |
| 1,769,113 | 7/1930 | Davenport | 62/220 |
| 2,718,122 | 9/1955 | Grimshaw | 62/512 |
| 4,726,160 | 2/1988 | Kawaguchi et al. | 62/157 |
| 5,228,308 | 7/1993 | Day et al. | 62/198 |
| 5,431,026 | 7/1995 | Jaster | 62/221 |

*Primary Examiner*—William Doerrler

*Attorney, Agent, or Firm*—Birch, Stewart, Kolasch & Birch, LLP

[57] ABSTRACT

A phase separator of a time shared dual evaporator cycle refrigerator includes an attachment unit formed at the end of a suction pipe and a cap formed at the attachment unit which prevents a flow of liquid refrigerant into a compressor. The liquid refrigerant which is flowing into a refrigerator compartment evaporator is expanded in a second capillary tube to be evaporated in a freezer compartment evaporator, and is then returned into the compressor. A refrigerant controlling unit determines the path of the refrigerant.

14 Claims, 4 Drawing Sheets

PRIRO ART

TIME SHARED DUAL EVAPORATOR CYCLE REFRIGERATOR

BACKGROUND OF THE INVENTION

The present invention relates to a refrigerator, and more particularly to a time shared dual evaporator cycle refrigerator in which the flow of liquid refrigerant into a compressor can be prevented.

The general refrigerator having one evaporator is non economic, since the refrigerant is evaporated below −26° C. to maintain refrigerator compartment and freezer compartment at 3° C. and −18° C., respectively. In the time shared dual evaporator(TSDUAL) cycle refrigerator of which evaporators are mounted in the refrigerator compartment and the freezer compartment, however, the freezer compartment evaporator evaporates the refrigerant at −24° C. to maintain the freezer compartment at −18° C., and the refrigerator compartment evaporator evaporates the refrigerant at 0°~6° C. to maintain the refrigerator compartment at 3° C. Thus, the cooling efficiency is improved and damage to the compressor can be prevented because of the reduction of the pressure pressing the compressor.

FIG. 1 is a schematic view of the refrigeration system of the conventional TSDUAL cycle refrigerator. As shown in FIG. 1, the compressor 1 is connected to the first capillary tube 3 through a condenser 2 in which the vapor refrigerant of high pressure and high temperature is condensed and then converted into the liquid refrigerant. The first capillary tube 3 is connected to a phase separator 5 through the refrigerator compartment evaporator 4. In the phase separator 5, two paths are formed which are connected to the freezer compartment evaporator 8 and a pressure switch 9 of a refrigerant controlling unit 6, respectively. Further, the freezer evaporator 8 is connected to the refrigerant controlling unit 6 which is connected to the compressor 1.

As shown in FIG. 2, the phase separator 5 is connected to the refrigerator compartment evaporator 4, the second capillary tube 7, and the compressor 1. The phase separator is filled with the vapor and liquid refrigerant, which has passed the refrigerator compartment evaporator 4.

As shown in FIGS. 1 and 2, the vapor refrigerant, high pressure and high temperature, compressed in the compressor 1 is converted into the liquid refrigerant in the condenser 2. This liquid refrigerant is expanded in the first capillary tube 3 and then converted into the vapor refrigerant by evaporation in the refrigerator compartment evaporator 4. The vapor refrigerant evaporated in the refrigerator compartment evaporator 4 and the liquid refrigerant, just past the refrigerator compartment evaporator 4, is flowing into the phase separator 5. The vapor refrigerant is sucked into the compressor 1 to be compressed and then condensed in the condenser 2 again, so that the vapor refrigerant is converted into the liquid refrigerant. The liquid refrigerant in the phase separator 5 is expanded and evaporated in the second capillary tube 7 and the freezer compartment evaporator 8 to cool the freezer compartment. Thereafter, the vapor refrigerant evaporated in the freezer compartment evaporator 8 is also flowing into the compressor 1.

Therefore, there are two paths in which the refrigerant is flowing as follows:

First path: compressor 1→condenser 2→first capillary tube 3→refrigerator compartment evaporator 4→phase separator 5→compressor 1.

Second path: compressor 1→condenser 2→first capillary tube 3→refrigerator compartment evaporator 4→phase separator 5→second capillary tube 7→freezer compartment evaporator 8→compressor 1. At this time, the vapor refrigerant separated in the phase separator 5 is flowing through the first path and the liquid refrigerant flowing through the second path. The refrigerant controlling unit 6 determine the path of the refrigerant. In other words, the pressure of the vapor refrigerant evaporated in the refrigerator compartment evaporator 4 is detected by the pressure switch 9 of the refrigerant controlling unit 6 and the path of the refrigerant is determined by the refrigerant controlling unit 6 based on the detected pressure, so that the vapor pressure of the refrigerator compartment evaporator 4 is controlled to cool the refrigerator compartment at an appropriate temperature.

In the aforementioned paths, since the second path is automatically determined by the first path, the second path is closed in a case where the first path is opened, and the second path is opened in a case where the first path is closed. In the TSDUAL cycle, thus, the compressor 1 is turned on or off according to the temperature of the freezer compartment, and the variation cycle of the refrigerant path varies gradually according to the variation of the pressure. When the compressor 1 is controlled to cool the freezer compartment at −18° C., because the cooling load is large in an initial state, the refrigerant is rapidly evaporated in the refrigerator compartment evaporator 4 so that the pressure of the refrigerator compartment evaporator 4 is rapidly decreased and then the pressure in the phase separator 5 is rapidly increased by the variation of the path again. Therefore, the variation cycles from the first path to the second path and from the second path to the first path become short. As a result, only a small amount of the refrigerant is flowing into the refrigerator compartment evaporator 8, so that a drop in temperature of the freezer compartment become negligible.

Thereafter, if the cooling load in the refrigerator compartment is gradually decreased, because the variation cycle of the refrigerant path becomes long, the amount of the refrigerant flowing into the freezer compartment evaporator 8 is increased so that the temperature in the freezer compartment is rapidly dropped.

In the above mentioned TSDUAL cycle, the driving of the refrigerator is determined according to the cooling load in the refrigerator compartment. When the evaporation pressure in the refrigerator compartment is risen to adjust the temperature in the refrigerator compartment at 6° C., or the user opens the door, the driving period of the first path becomes long by an increase of the cooling load, so that the phase separator 5 is filled full with liquid refrigerant.

As shown in FIG. 2, when the phase separator 5 is filled full with the liquid refrigerant, since the liquid refrigerant is flowing into the suction pipe 10 which is connected to the compressor 1, the temperature of the refrigerator compartment evaporator 4 is not dropped in spite of the flow of the refrigerant through the first path. Thus, the refrigerant is not flowing into the freezer compartment evaporator 8 and then the temperature of the freezer compartment is not dropped. The liquid refrigerant, flowing into the compressor 1 through the suction pipe 10, causes damage to the compressor 1. In the suction pipe 10, in addition, a water drops are generated because of liquid refrigerant of low temperature, and then water is collected in the bottom of the refrigerator.

SUMMARY OF THE INVENTION

One object of the invention is to provide a time shared dual evaporator cycle refrigerator in which damage to the compressor can be prevented by blocking liquid refrigerant flow into the compressor.

Another object of the invention is to provide a time shared dual evaporator cycle refrigerator in which the collection of water in the bottom of the refrigerator by generation of the waterdrops on the surface of the suction pipe can be prevented.

In order to achieve the above objects, the present invention comprises a compressor for compressing vapor refrigerant at high temperature and high pressure, a condenser for condensing the vapor refrigerant to convert into liquid refrigerant, the first capillary tube connected to the condenser for expanding the liquid refrigerant, a refrigerator compartment evaporator connected to the first capillary tube for evaporating the liquid refrigerant, a phase separator into which the vapor refrigerant evaporated in the refrigerator compartment evaporator and the liquid refrigerant passing the refrigerator compartment evaporator is flowing, a refrigerant controlling unit connected to the phase separator through the suction pipe, into which the vapor refrigerant is flowing from the phase separator, means for preventing flow of the liquid refrigerant into the compressor through the suction pipe, mounted on the end of the suction pipe, a second capillary tube for expanding the liquid refrigerant from the phase separator, and a freezer compartment evaporator for evaporating the liquid refrigerant flowed from the second capillary tube. The refrigerant controlling unit is also connected to the freezer compartment evaporator so that the vapor refrigerant evaporated in the freezer compartment evaporator is flowing into the compressor. A pressure switch is mounted on the refrigerant controlling unit detects pressure of the vapor refrigerant flowing from the phase separator so that the refrigerant controlling unit determines the path.

The inflow preventing means including an attaching unit and a cap prevents the liquid refrigerant from flowing into the compressor through the suction pipe, because if the phase separator is filled full with the liquid refrigerant, the cap is closed by buoyancy of the liquid refrigerant.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE INVENTION

Figure 1:
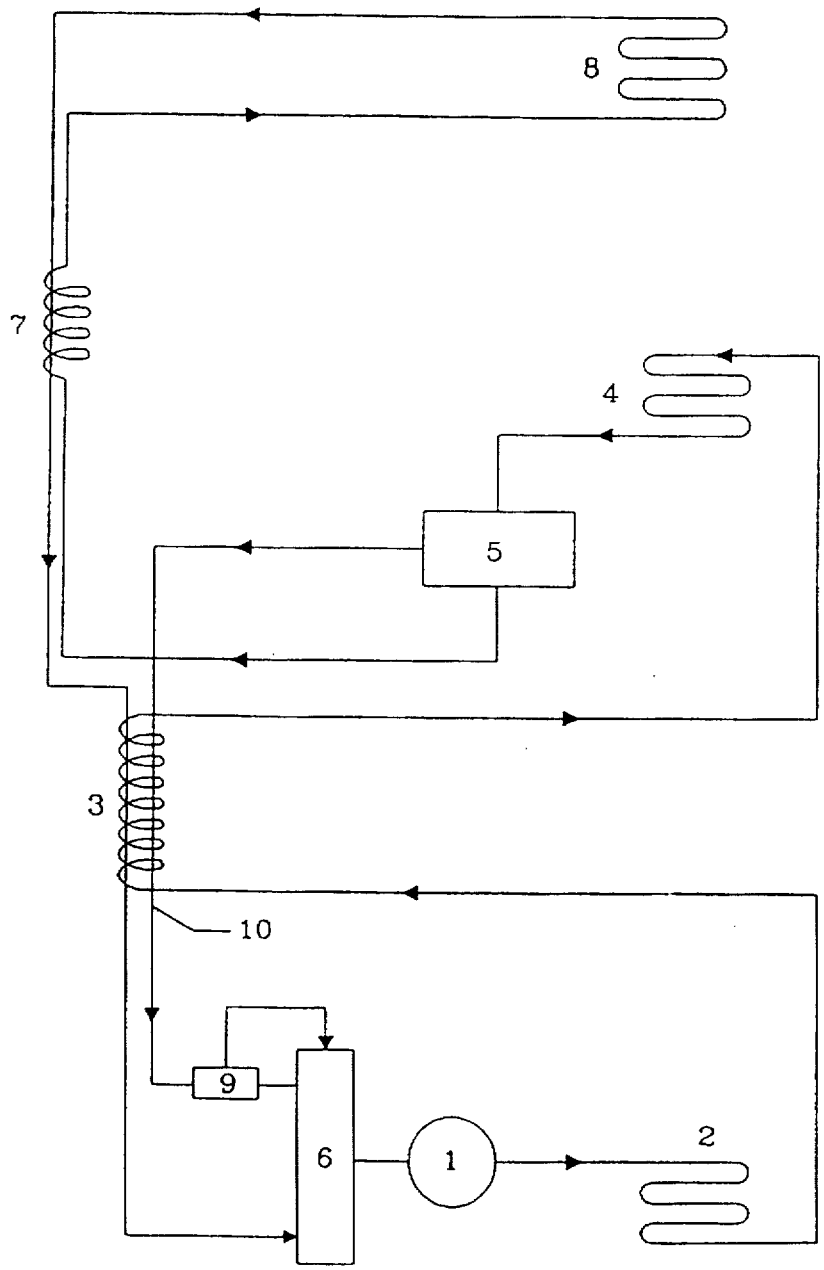
FIG. 1 is a schematic view of the conventional time shared dual evaporator cycle refrigerator.
Figure 2:
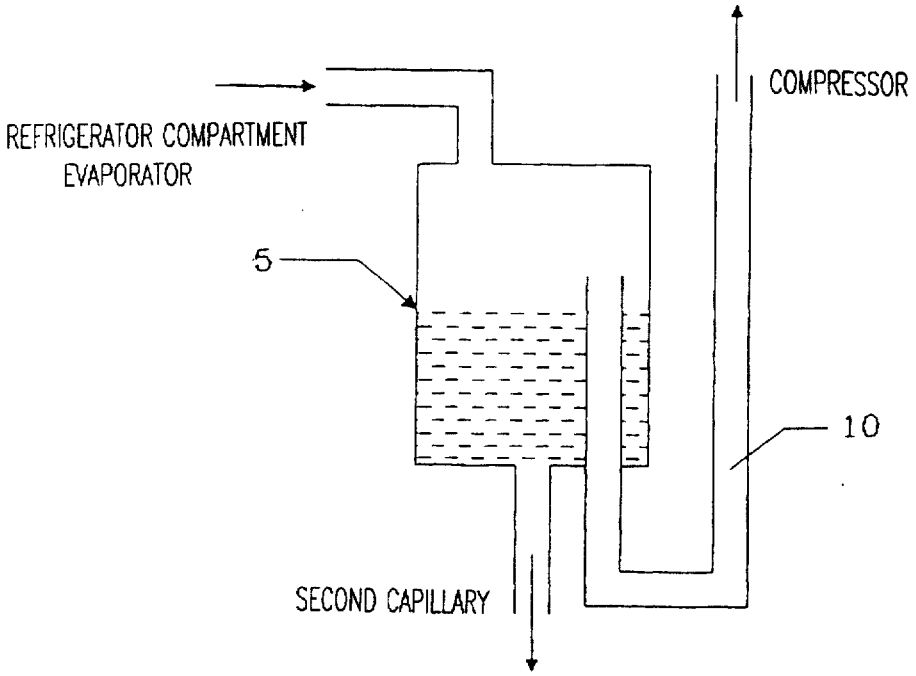
FIG. 2 PRIOR ART
FIG. 2 is a view showing a phase separator of the conventional time shared dual evaporator cycle refrigerator.
Figure 3A:
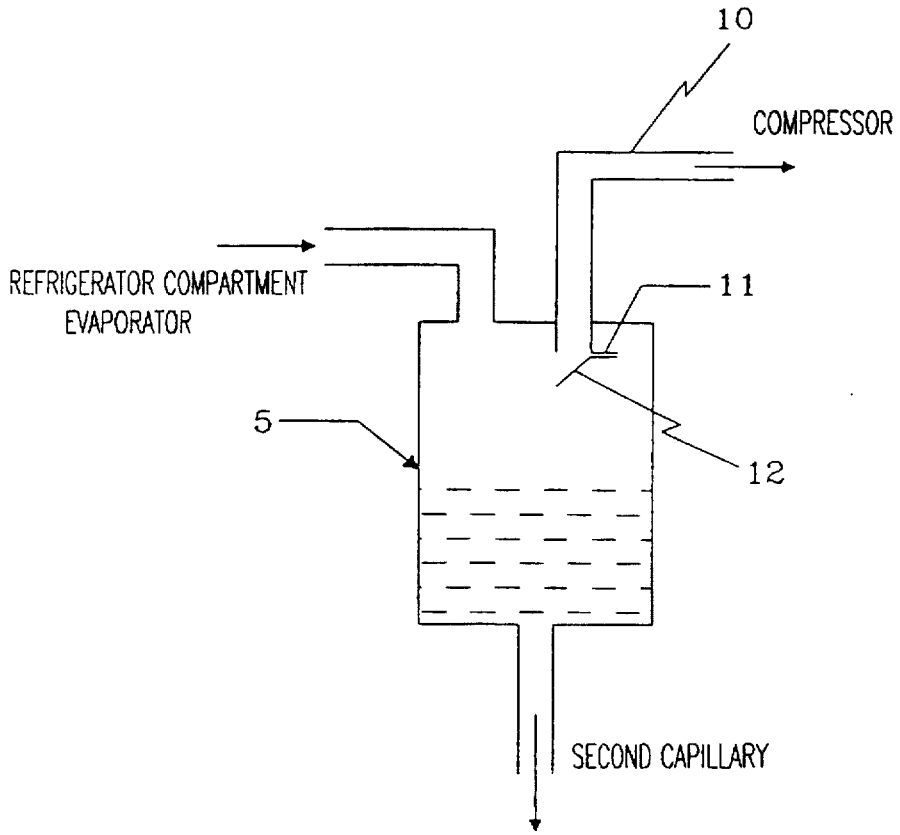
FIG. 3*a* is a view showing the phase separator of the present time shared dual evaporator cycle refrigerator.
Figure 3B:
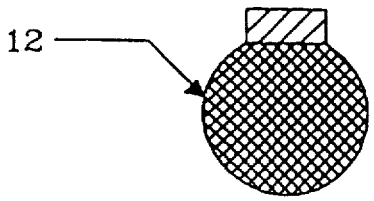
FIG. 3*b* is a view showing the cap of the present time shared dual evaporator cycle refrigerator.

Referring to FIG. 1 and 3, the compressor 1 is connected to the first capillary tube 3 through a condenser 2 in which the vapor refrigerant of high pressure and temperature is condensed and then converted into the liquid refrigerant. The first capillary tube 3 is connected to a phase separator 5 through the refrigerator compartment evaporator 4. In the phase separator 5, two paths are formed which are connected to the freezer compartment evaporator 8 and a pressure switch 9 of a refrigerant controlling unit 6, respectively. Further, the freezer evaporator 8 is connected to the refrigerant controlling unit 6 which is connected to the compressor 1.

The suction pipe 10 connecting the phase separator 5 and the refrigerant controlling unit 6 is extruded into the inside of the phase separator 5. An attachment unit 11 is formed at the end of the suction pipe 10 inside of the phase separator 5. In the attachment unit 11, a cap 12 is mounted. When the phase separator 5 is filled full with the liquid refrigerant, the cap 12 closes the suction pipe 10 by buoyancy of the liquid refrigerant.

The vapor refrigerant compressed in the compressor 1 is converted into the liquid refrigerant in the condenser 2. This liquid refrigerant is expanded in the first capillary tube 3 and then converted into the vapor refrigerant by evaporation in the refrigerator compartment evaporator 4. The vapor refrigerant evaporated in the refrigerator compartment evaporator 4 and the liquid refrigerant, just past the refrigerator compartment evaporator 4, is flowing into the phase separator 5. The vapor refrigerant is sucked and compressed in the compressor 1 and then condensed in the condenser 2 again, so that the vapor refrigerant is converted into the liquid refrigerant. The liquid refrigerant in the phase separator 5 is expanded and evaporated in the second capillary tube 7 and the freezer compartment evaporator 8 to cool the freezer compartment. The vapor refrigerant evaporated in the freezer compartment evaporator 8 is also flowing into the compressor 1. Thereafter, this process is repeated.

When the cooling load is increased, the driving period of the first path(compressor 1→condenser 2→first capillary tube 3→refrigerator compartment evaporator 4→phase separator 5→compressor 1) becomes long. Accordingly, the phase separator 5 is filled full with the liquid refrigerant to raise the liquid refrigerant level. The cap 12, shown in FIG. 3*b*, closes the suction pipe 10 by buoyancy of the liquid refrigerant, so that the liquid refrigerant cannot flow into the suction pipe 10.

Figure 4:
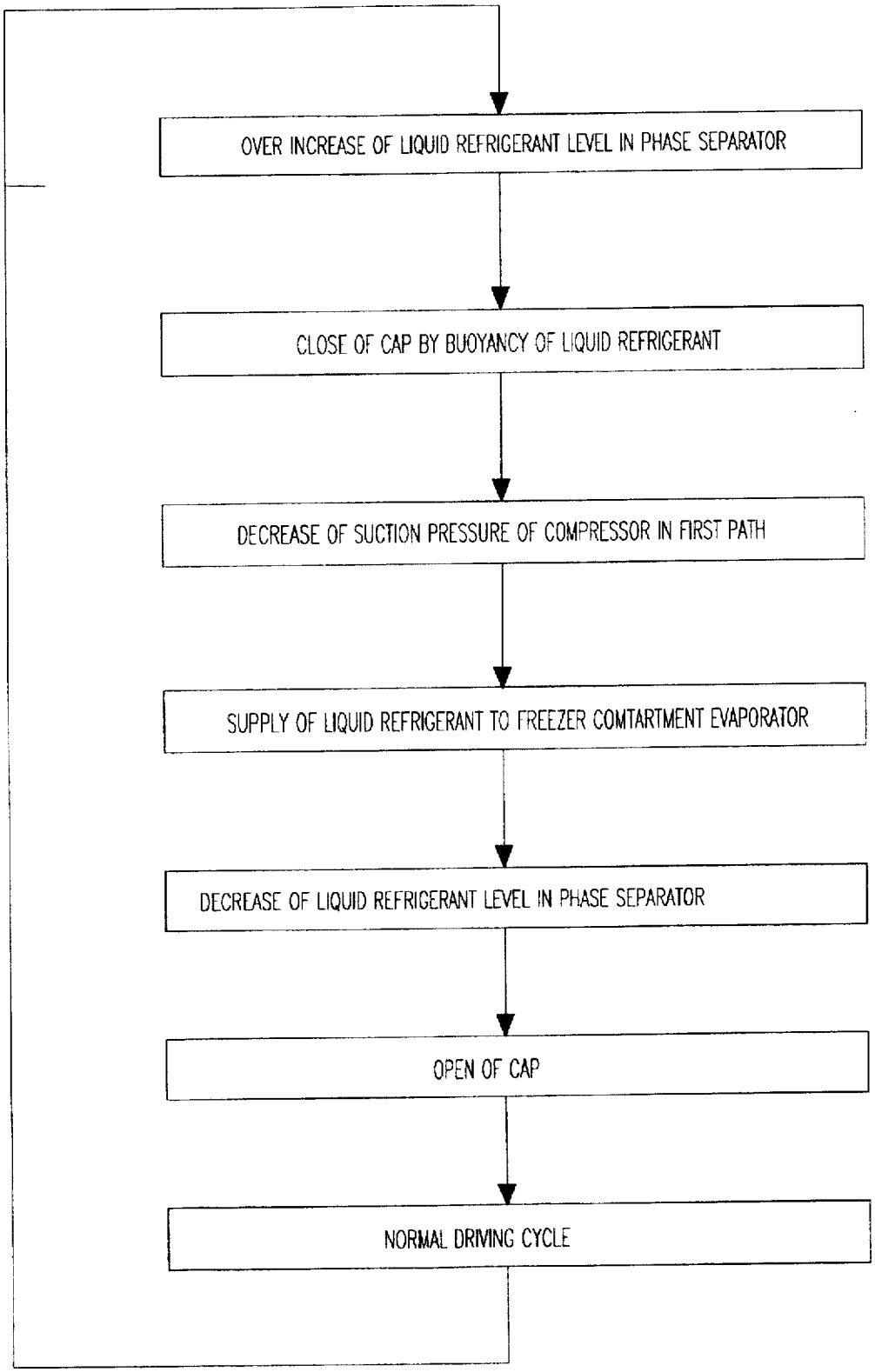
FIG. 4 is a flow chart of the present time shared dual evaporator cycle refrigerator.

FIG. 4 is a flow chart of the present time shared dual evaporator cycle refrigerator. As shown in FIG. 4, the cap closes the suction pipe 10 by the buoyancy so that the suction pressure of the compressor 1 is decreased when the cooling load in the refrigerator compartment is increased. At the same time, the liquid refrigerant is supplied to the freezer compartment evaporator 4 by the pressure difference in the phase separator 5. Thus, the liquid refrigerant level in the phase separator 5 is dropped and the cap 12 opens the suction pipe 10 for normal driving. Thereafter, when the cooling load is increased again, the aforementioned operation is repeated.

In the above mentioned time shared dual evaporator cycle refrigerator, because the flow of the liquid refrigerant into the compressor is prevented by the cap mounted on the suction pipe, damage to the compressor can be prevented and consumption of power can be decreased.

While the preferred form of the present invention has been described, it is to be understood that modifications will be apparent to those skilled in the art without departing from the spirit of the invention.

The scope of the invention, therefore, is to be determined solely by the following claims.

What is claimed is:

1. A time shared dual evaporator cycle refrigerator, comprising:

a compressor for compressing refrigerant;

a condenser for condensing said refrigerant so as to convert said refrigerant into liquid refrigerant, said condenser being connected to said compressor;

a first capillary tube for expanding said liquid refrigerant, said first capillary tube being connected to said condenser;

a first evaporator for evaporating said liquid refrigerant, said first evaporator being connected to said first capillary tube;

a phase separator for separating said refrigerant into liquid refrigerant and vapor refrigerant, said phase separator being connected to said first evaporator;

means for preventing flow of said liquid refrigerant into said compressor, the preventing means being mounted on a suction pipe which is connected with said compressor, said preventing means comprising an attachment unit formed in said suction pipe, and a cap formed at said attachment unit;

a second capillary tube for expanding said liquid refrigerant, said second capillary tube being connected to said phase separator;

a second evaporator for evaporating said liquid refrigerant, said second evaporator being connected to said second capillary tube; and a refrigerant controlling unit for determining a path of said refrigerant, said refrigerant controlling unit being connected to said phase separator and said second evaporator.

2. The time shared dual evaporator cycle refrigerator according to claim 1, further comprising a pressure switch for detecting pressure of said vapor refrigerant evaporated in said first evaporator, said pressure switch being connected to said phase separator.

3. The time shared dual evaporator cycle refrigerator according to claim 1, wherein said first evaporator includes a refrigerator compartment evaporator.

4. The time shared dual evaporator cycle refrigerator according to claim 1, wherein said second evaporator includes a freezer compartment evaporator.

5. A time shared dual evaporator cycle refrigerator, comprising:

means for condensing refrigerant so as to convert said refrigerant into liquid refrigerant;

means for cooling a refrigerator compartment, the refrigerator compartment cooling means being connected to the condensing means;

means for separating phase of said refrigerant, the phase separating means being connected to the refrigerator compartment cooling means;

means for preventing flow of said liquid refrigerant into a suction pipe which is connected to said phase separating means, the preventing means being formed at said suction pipe, said preventing means comprising an attachment unit formed in said suction pipe, and a cap formed at said attachment unit;

means for cooling a freezer compartment, the freezer compartment cooling means being connected to the phase separating means; and means for controlling refrigerant so as to determine a path of said refrigerant, the controlling means being connected to the refrigerator compartment cooling means and the freezer compartment cooling means.

6. The time shared dual evaporator cycle refrigerator according to claim 5, wherein said condensing means comprises:

a compressor for compressing said refrigerant; and a condenser for converting said refrigerant into liquid refrigerant.

7. The time shared dual evaporator cycle refrigerator according to claim 5, wherein said refrigerator compartment cooling means comprises:

a capillary tube for expanding said refrigerant, said capillary tube being connected to said condensing means; and an evaporator for evaporating said refrigerant, said evaporator being connected to said capillary tube.

8. The time shared dual evaporator cycle refrigerator according to claim 5, wherein said freezer compartment cooling means comprises:

a capillary tube for expanding said liquid refrigerant, said capillary tube being connected to said phase separating means; and an evaporator for evaporating said liquid refrigerant, said evaporator being connected to said capillary tube.

9. A time shared dual evaporator cycle refrigerator, comprising:

means for condensing refrigerant so as to convert said refrigerant into liquid refrigerant;

means for cooling a refrigerator compartment, the refrigerator compartment cooling means being connected to the condensing means;

means for separating phase of said refrigerant, the phase separating means being connected to the refrigerator compartment cooling means;

means for preventing flow of said liquid refrigerant into a suction pipe which is connected to said phase separating means, the preventing means being formed at said suction pipe;

means for cooling a freezer compartment, the freezer compartment cooling means being connected to the phase separating means; and means for controlling refrigerant so as to determine a path of said refrigerant, the controlling means being connected to the refrigerator compartment cooling means and the freezer compartment cooling means, wherein said refrigerant controlling means comprises:

a pressure switch for detecting a pressure of vapor refrigerant, said pressure switch being connected to said phase separating means; and a refrigerant controlling unit for determining a path of said refrigerant based on said pressure detected by said pressure switch.

10. A phase separating system of a time shared dual evaporator cycle refrigerator, comprising:

a phase separator for phase-separating refrigerant into vapor refrigerant and liquid refrigerant, said phase separator being connected to a refrigerator compartment evaporator for cooling a refrigerator compartment, a freezer compartment evaporator for cooling a freezer compartment, and a compressor through a suction pipe; and means for preventing flow of liquid refrigerant into said compressor, the preventing means being formed at said suction pipe.

11. The phase separating system of a time shared dual evaporator cycle refrigerator according to claim 10, wherein said preventing means comprises:

an attachment unit formed at an end of said suction pipe; and a cap formed at said attachment unit.

12. The time shared dual evaporator cycle refrigerator according to claim 1, wherein the cap closes an end of the suction pipe by buoyancy of the liquid refrigerant in the phase separator.

13. The phase separating system of a time shared dual evaporator cycle refrigerator according to claim 5, wherein the cap closes an end of the suction pipe by buoyancy of the liquid refrigerant in the phase separator.

14. The time shared dual evaporator cycle refrigerator according to claim 11, wherein the cap closes an end of the suction pipe by buoyancy of the liquid refrigerant in the phase separator.

* * * * *